United States Patent [19]

Hind et al.

[11] 4,131,219

[45] Dec. 26, 1978

[54] POURING OF MOLTEN METALS

[75] Inventors: Robert D. Hind, Rotherham; Anthony Thrower; Joseph W. Cudby, both of Sheffield, all of England

[73] Assignee: United States Steel Corporation, Pittsburgh, Pa.

[21] Appl. No.: 818,792

[22] Filed: Jul. 25, 1977

[30] Foreign Application Priority Data

Aug. 3, 1976 [GB] United Kingdom ..... 32195/76

[51] Int. Cl.[2] ..... F16K 51/00

[52] U.S. Cl. ..... 222/603; 164/66; 222/152; 222/600; 266/236

[58] Field of Search ..... 164/66, 259, 335, 337; 222/603, 600, 590, 152; 266/217, 236

[56] References Cited

U.S. PATENT DOCUMENTS

| | | | |
|---|---|---|---|
| 3,451,594 | 6/1969 | Stewart | 164/66 |
| 3,673,039 | 6/1972 | Todd | 222/603 |
| 3,926,406 | 12/1975 | Hind | 222/600 |
| 3,980,271 | 9/1976 | Hind et al. | 222/600 |

FOREIGN PATENT DOCUMENTS

| | | | |
|---|---|---|---|
| 4618855 | 7/1968 | Japan | 164/66 |
| 781276 | 8/1957 | United Kingdom | 164/66 |
| 229755 | 2/1969 | U.S.S.R. | 164/259 |

*Primary Examiner*—Francis S. Husar
*Assistant Examiner*—John McQuade
*Attorney, Agent, or Firm*—John F. Carney

[57] ABSTRACT

Oxidation of a molten metal pour stream is prevented by enclosing the stream in a shroud formed by one or more jets of inert gas arranged to envelope the stream.

8 Claims, 6 Drawing Figures

POURING OF MOLTEN METALS

BACKGROUND OF THE DISCLOSURE

The present invention concerns improvements relating to the pouring of molten metals for example from a ladle into a receiving vessel such as a mould or a tundish of a continuous casting plant.

More particularly, the invention relates to a technique and equipment by means of which a stream of molten metal, established when pouring the metal from one vessel into another vessel, can be protected from oxidizing. We have found that a well protected stream can be obtained surprisingly readily with the aid of a jet or a plurality of jets of gas arranged to envelop the stream with a generally annular gaseous curtain.

SUMMARY OF THE INVENTION

Accordingly, one aspect of the present invention comprises a method of pouring molten metal during casting, wherein the metal is caused to issue as a molten stream from a nozzle, and gas is ejected under pressure from an orifice or orifices adjacent an exit end of the nozzle, the gas being ejected in the general direction in which the metal issues from the nozzle and in such a manner that at least part of the length of the emergent stream in the vicinity of the nozzle exit is enveloped by a confining annular curtain of the flowing gas. There will no doubt be a tendency for the flowing gas gradually to diverge from the metal stream and hence to become dissipated into the surrounding atmosphere. The length of the metal stream that can be effectively screened by the gas curtain will depend inter alia on how smooth the stream is, particularly under throttling conditions when a tendency for the stream to spray exists. By varying the pressure and gas flow rate, the length and effectiveness of the gas curtain can be controlled.

According to a second aspect of the invention, there is provided apparatus for pouring molten metal from one vessel to another, comprising a nozzle for discharging a stream of molten metal from the first vessel towards the second vessel, and gas ejecting means including an orifice or orifices adjacent an exit end of the nozzle, the gas ejecting means being operable to eject gas in the general direction of the molten metal stream discharged from the nozzle and in such a manner that a confining annular curtain of the flowing gas will envelop at least part of the length of the emergent stream in the vicinity of the nozzle exit.

The nozzle can form part of a sliding gate valve.

Accordingly, another aspect of the invention provides a sliding gate valve for controlling the flow of molten metals, comprising a stationary apertured upper valve plate, a reciprocable apertured lower slide plate movable in contact with the underside of the upper plate to bring the apertures in the two plates into and out of registry to open and close the valve, a discharge nozzle mounted below the lower plate in coincidence with the lower plate orifice, and gas ejecting means including an orifice or orifices to eject gas at the vicinity of an exit end of the discharge nozzle and in the general direction of discharge therefrom, the gas ejecting means being operable to create in the vicinity of the nozzle exit a confining annular curtain of the gas which in use envelops and confines at least part of the length of a stream of molten metal discharged from the nozzle.

Choice of gas to be ejected is dependent upon the metal to be poured. For steel pouring, a non-oxidising gas such as an inert gas e.g. nitrogen or argon may be used not only to confine and smooth the stream, but also to protect it from undesirably contact with the air and so prevent oxidation of the molten metal.

The gas can be ejected from the orifice(s) parallel to the emerging metal stream, or at an angle thereto. Where the orifice(s) eject gas at an angle to the stream, it may be desirable to deflect the flowing gas towards a path parallel to the stream or, alternatively, the gas may impinge on the emergent metal stream at an acute angle thereto.

In one preferred embodiment of the invention, a sliding gate valve has the gas ejecting means comprising a chamber, disposed about the nozzle, into which the pressurised gas is fed, and the chamber has a restricted, ring-shaped orifice through which the gas is ejected. The said chamber can comprise a component of securing means whereby the nozzle per se, or an expendable, replaceable nozzle tip, is mounted below the lower slide plate. The nozzle or nozzle tip can feature an inwardly and downwardly tapered end surface for deflecting gas ejected from the orifice along a path generally parallel to the metal stream emerging from the discharge nozzle.

The invention comprehends a metal pouring vessel such as a ladle when fitted with a sliding gate valve embodying the invention.

BRIEF DESCRIPTION OF THE DRAWINGS

The present invention will now be described in more detail by way of example only with reference to the accompanying drawings, in which.

DESCRIPTION OF THE PREFERRED EMBODIMENTS OF THE INVENTION

Figure 1:
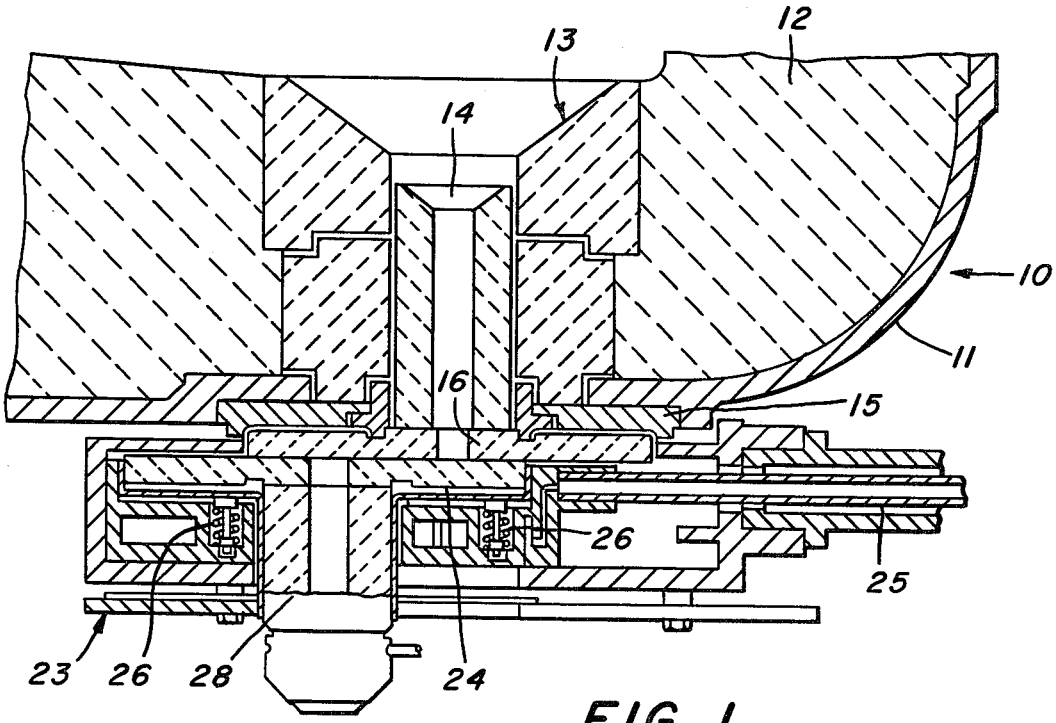
FIG. 1 is a partial cross-sectional view of a ladle fitted with a sliding gate valve embodying the invention.

In FIG. 1 there is shown a ladle 10 having a metal casing 11 containing a refractory lining 12. The ladle 10 has a bottom-pour opening including a well 13 and nozzle 14. A mild steel mounting plate 15 provides a means for locating the nozzle 14 and a stationary orifice plate 16 of a sliding gate valve such that the nozzle passage and the orifice of plate 16 are concentric.

Flow of metal through the bottom-pour opening is controlled by a sliding gate valve 23. The valve 23 co-operates with the stationary orifice plate 16, the valve having an orificed, reciprocal slide plate 24, which is slidable to and fro under the stationary orifice plate 16. Movement of the slide plate 24 is gained by a push/pull rod 25 operated by an hydraulic actuator, not shown. The slide plate 24 is biased into face-to-face, sealing engagement with the underside of the stationary orifice plate 16 by a plurality of springs 26. A discharge nozzle 28 through which a jet or stream of molten metal issues when the valve is open is secured to the slide plate 24.

The parts of the valve 23 which come into contact with the molten metal, namely, the stationary plate 16, the slide plate 20 and the nozzle 28, are made from refractory materials. A high-density alumina refractory containing 85–90% $Al_2O_3$ is suitable for the stationary plate 16 and the slide plate 24.

It will be understood that the valve 23 is shown closed in FIG. 1, the passage through the slide plate 24 and the nozzle 28 being out of registry with the orifice of the stationary plate 16. The valve is fully open when the said passage is moved into exact registry with the orifice of the stationary plate 16. The slide plate 24 serves to meter the flow of molten steel when it is in an intermediate position partially covering the orifice of the stationary plate 16.

Figure 2:
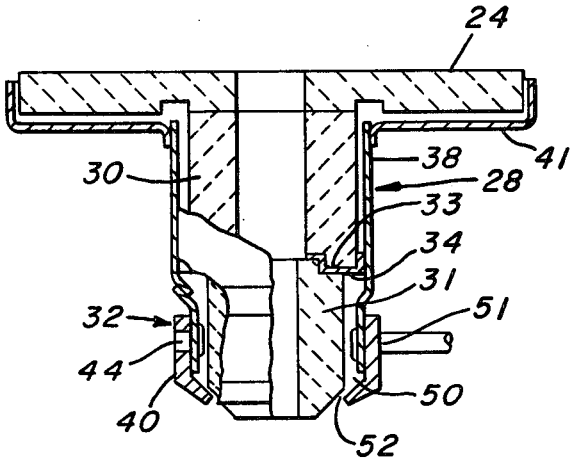
FIG. 2 is a cross-sectional and partial elevational view of a slide plate and discharge nozzle assembly of a sliding gate valve embodying the invention.

The assembly shown in FIG. 2 comprises the slide plate 24 and the depending nozzle 28, the latter including a composite, two-part refractory component and means to be described for ejecting gas in the general direction in which metal is discharged from the nozzle. The two-part refractory component has an upper refractory tube 30 and a lower tubular refractory tip 31. Supporting means 32 is provided to mount the tip 31 beneath the tube 30 in axial alignment therewith and the tube and tip have confronting stepped end faces at 33 which are bonded together by cement 34. The cement bond is readily frangible to allow easy replacement of the tip 31 when worn. The tip 31 is encased in a thin metal casing 35, which is crimped or swaged to a frusto-conical form at its bottom end to match a similarly-shaped bevelled end 36 of the tip 31, see FIG. 3.

The supporting means 32 comprises a tubular metal sleeve 38, which extends along a major part of the length of the nozzle 28, and a metal tip ring 40. At its upper end, the sleeve 38 is secured to a reinforcing pan 41 which is suitably fastened to the periphery of the slide plate 24. Between its ends, the sleeve is bonded in a gas tight manner to the upper refractory tube 30 by the cement 34. As shown, the sleeve 38 is necked towards its bottom, smaller-diameter end. Such necking can be achieved by swaging the sleeve 38 or by making it from two flanged parts that are joined together in a gas tight manner, for example by welding. These two alternatives are illustrated in FIG. 2, the swaged construction appearing at the right-hand side of the Figure and the welded, flanged construction at the left-hand side. The tip ring 40 is releasably connected to the sleeve 38, to allow disassembly when replacing worn refractory parts. In this instance, a bayonet coupling connects tip ring 40 and sleeve 38. The bayonet coupling consists of a plurality of outwardly-projecting pins 44 welded to the smaller-diameter end of the sleeve, and cooperating slots 45 in the tip ring 40. It is arranged that the tip ring 40 and sleeve 38 form a gas tight seal, for example with the aid of a suitable high temperature sealing means or medium, to prevent gas from escaping via the bayonet coupling. The tip ring 40 engages the frusto-conically shaped portion of the casing 35 at a plurality of spaced abutments 46 around the inner periphery of an inwardly-tapered lip 48 of the ring 40.

For the purpose of providing means for ejecting gas in the general direction in which metal issues from the nozzle 28, the nozzle includes a gas reservoir 50, a gas inlet 51 and an annular orifice 52. The reservoir 50 consists of an annular chamber formed by a space between the components of the supporting means 32 and the composite two-part refractory component. The inlet 51 includes a conduit 53 which is secured in a gas tight manner to one of the bayonet pins 34, the pin in question being hollow to allow insertion of the conduit therein. In use, conduit 53 feeds pressurized gas such as argon or nitrogen from a suitable source of the gas, not shown, via inlet 51 into the reservoir 50. As has been explained, the nozzle 28 includes several gas tight joints, and the only route for pressurized gas to leave the nozzle 28 is through the annular orifice 52. Orifice 52 is a restricted opening formed between the frusto-conical portion of the metal casing 35 and a marginal edge 54 of the lip 48.

To reach the orifice 52 from the reservoir 50, the gas has to flow between the lip 48 and the casing 35, bypassing the abutments 46. To allow the gas so to bypass, the internal surface of the lip includes a series of spaced apart grooves 55. The grooves 55 interconnect to encircling hollows 56, 58 in the lip internal surface, located one to either side of the abutments 46.

It is envisaged that, in use, gas will be fed to the reservoir at a pressure of the order of 10 to 20 p.s.i. or greater. Satisfactory results could be obtained if the gas is ejected from the orifice 52 at a flow rate of the order of 30 to 40 cu. ft. per min. or more. These figures are merely illustrative and may be readily varied to obtain optimum performance.

Figure 3:
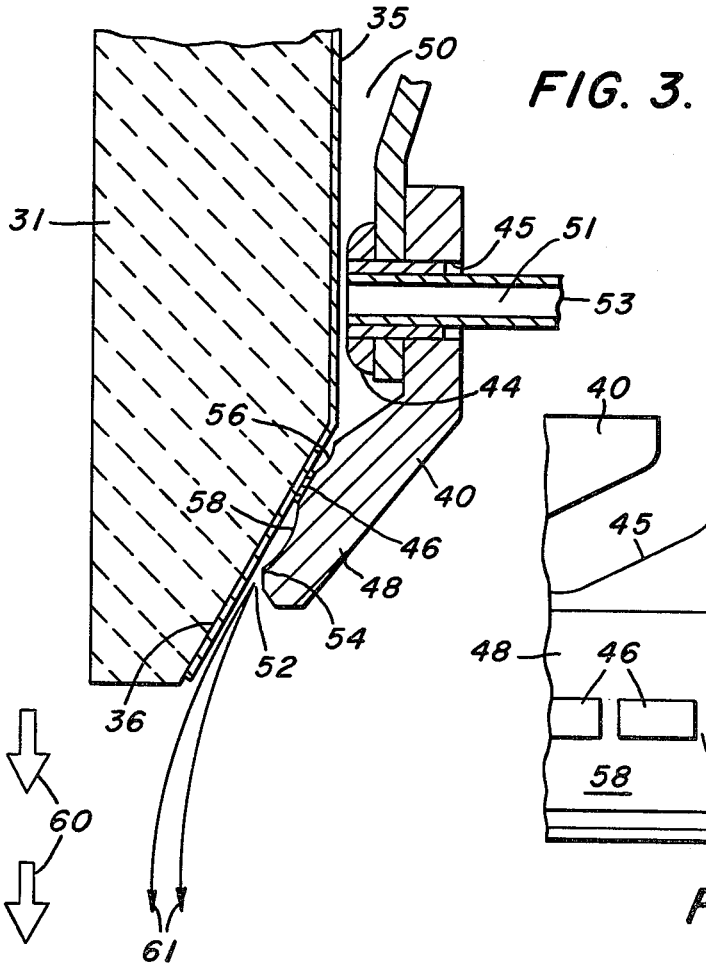
FIG. 3 is an enlarged sectional view of a portion of the assembly shown in FIG. 2.
Figure 4:
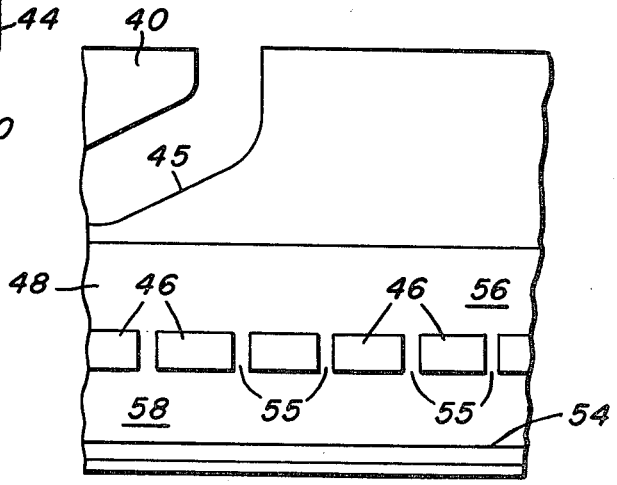
FIG. 4 is an enlarged, fragmentary developed view of one of the components of the assembly shown in FIG. 2.

The shape of the encircling hollow 58 is such that as gas sweeps thereover in its movement towards the orifice 52, it is given a tendency to impinge on the frusto-conical portion of the casing 35. The casing configuration is such as to help deflect the issuing gas towards the general direction of metal flow from the nozzle 28. The metal flow direction is indicated in FIG. 3 by arrows 60 and the gas flow direction by arrows 61.

The illustrated construction produces a confining, smoothing annular curtain of gas about the metal stream emerging from the nozzle. The gas isolates the stream from the atmosphere and hence can be used to reduce or eliminate oxidation of the molten metal.

Since the gas leaving the reservoir 50 impinges on or sweeps across the frusto-conical portion of the casing, the annular orifice 52 could possibly be omitted in a modification. Thus, the gas could be ejected directly from the grooves 55 in the tip ring 40 onto the casing 35. The issuing gas may exhibit a tendency to spread laterally in the course of impinging on and sweeping across the casing, and so result in an annular curtain of gas enveloping the metal stream.

Figure 5:
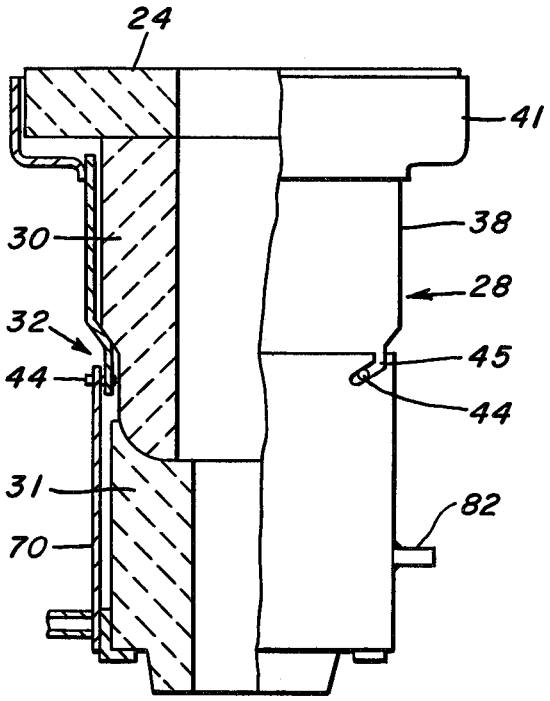
FIG. 5 is a part cross-sectional and part elevational view of another slide plate and discharge nozzle assembly embodying the invention.
Figure 6:
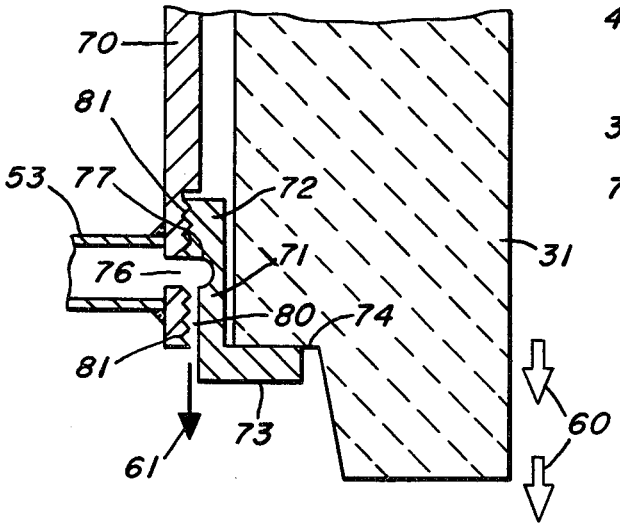
FIG. 6 is an enlarged cross-sectional view of a portion of the assembly shown in FIG. 5.

A second embodiment of the invention is shown in FIGS. 5 and 6, and in these Figures like reference numerals are used for parts that are substantially the same as parts described hereinbefore.

In this embodiment, the two-part refractory component has the parts 30, 31 meeting at confronting edges which are complementarily rediussed so as to interfit snugly. The mating radiussed surfaces serve to centralise the parts 30, 31 with respect to one another. Cement bonding the parts 30, 31 can be omitted.

In this embodiment, the tip 31 is supported by support means 32 comprising the sleeve 38 and a detachable sleeve 70, the sleeves being interconnected for example by a releasable bayonet coupling 44, 45. Detachable sleeve 70 is right cylindrical and has an abutment ring 71 fitted to its lower end. The abutment ring 71 is L-shaped in cross-section, having a cylindrical wall 72 extending inwardly into the sleeve 70 and a radially-inwardly extending flange or lip 73 which abuts a peripheral part of a bottom end face 74 of the tip 31. As shown, the said peripheral part of face 74 of the tip 31 is planar. The abutment between the lip 73 and the said peripheral part is responsible in conjunction with the bayonet coupling 44, 45 for urging tip 31 against the refractory tube 30.

In this case, the means to eject gas are arranged to eject the gas in a direction 61 parallel to the metal stream direction 60. The said means comprises an inlet 76, formed in the wall of the detachable sleeve 70 adjacent the bottom end thereof, a reservoir 77 and a ring-form orifice 78. A gas supply conduit 53 is welded to the sleeve 70 in line with the inlet 76. The reservoir 77 here comprises an encircling recess formed in the outer face of the wall 72 of the ring 71. The inlet 76 is located directly opposite the reservoir recess 77.

The sleeve 70 and ring 71 have confronting surfaces shaped to allow pressurised gas to escape downwardly from the reservoir recess 77. Accordingly, the confronting surfaces below the reservoir recess can be spaced apart to provide a cylindrical gas flow passage 80 extending to the ring-form orifice 78. As shown, the lower end of the sleeve 70 is counter bored and internally screw threaded as shown at 81. The portion of the cylindrical wall 72 above the reservoir recess 77 is alone screw-threaded, to interfit with the threads in the sleeve 70. Below the reservoir recess 77, the wall 72 is smooth and has an external diameter less than the minimum internal diameter of the screw threads therein so as to define the flow passage 80.

In this construction, the interfitting threads of the sleeve 70 and ring 71 can be made gas-tight to prevent pressurized gas from escaping upwardly into the region between the sleeve 70 and the refractory tip 31. To ensure gas-tightness, the junction between the upper end of the cylindrical wall 72 and the inside wall of the sleeve 70 can be cemented or welded together. The gas-tight joint between sleeve 70 and ring 72 removes the need to provide the several gas-tight joints that have been described in relation to the first embodiment.

To assist the operator to manipulate the bayonet coupling, two or more handles 82 can be fastened to the sleeve 70. Clearly, such handles 82 can with advantage be fitted to the first embodiment.

In the event that a ladle fitted with a sliding gate valve is scheduled from time to time to be used in submerged pouring, where shrouding by means of a gas curtain is omitted, either of the described embodiments can be adapted whereby the tip ring 40 or the sleeve 70 and ring 72 serve to hold a submerged pouring tube. The second embodiment is particularly adaptable in this respect. After releasing the bayonet coupling, the sleeve 70 can simply be dropped together with the tip 31. The tip 31 can then be replaced by a submerged pouring tube having an upper end shaped to interfit with the lower end of the tube 30, and a circumferential groove or ledge in its outer surface for engagement with the radially inwardly extending lip 73 of the ring 71. The groove or ledge is, of course, so located along the submerged pouring tube that the end thereof to be submerged is remote from the ring 71.

It will be appreciated that the invention is of use e.g. when pouring molten metal from ladle to tundish or from tundish to mould. It will further be recognized that the invention is not limited to use with the simple sliding gate valve shown in FIG. 1. Thus, the present discharge nozzle assembly can be incorporated inter alia in a three plate gate valve (in which the nozzle assembly is stationary) and in a two or multi-orifice gate valve.

We claim:

1. In combination with a nozzle having a frusto-conically tapered end portion for discharging a stream of molten metal, means for ejecting gas under pressure cocurrently with the molten metal stream in surrounding relation thereto over at least part of the emergent metal stream, said means comprising:

(a) a tubular member concentrically spaced from said nozzle and cooperating therewith to define an annular gas reservoir;

(b) gas inlet means communicating with said gas reservoir;

(c) said tubular member including a frusto-conical lip portion cooperating with the tapered end portion of said nozzle to define a convergent, open-ended annulus therebetween;

(d) a plurality of circumferentially spaced abutments disposed in said annulus to maintain the spacing between said tubular member and said nozzle; and (e) said lip portion including a shallow, arcuate hollow downstream of said abutments operative to deflect gas passing through said annulus against the tapered end portion of said nozzle.

2. Apparatus according to claim 1, wherein the lip portion downstream of the hollow thereof is spaced from the nozzle end portion to provide a single, circumferentially-continuous, restricted annular gas ejection orifice.

3. Apparatus according to claim 1 in which one of said frusto-conically shaped portions is crenellated to form said spacer abutments.

4. In combination with a nozzle having an open end for discharging a stream of molten metal, means for ejecting gas under pressure concurrently with the molten metal stream in surrounding relation thereto over at least part of the emergent metal stream, said means comprising:

(a) a tubular member concentrically disposed about said nozzle;

(b) an abutment ring including a generally cylindrical wall received snugly inside the end of said tubular member and being adapted to engage said nozzle adjacent its open end;

(c) the wall of said abutment ring having a groove confronting the adjacent inside surface of said tubular member to form a gas reservoir;

(d) gas inlet means communicating with said gas reservoir; and (e) the wall of said abutment ring downstream of said gas reservoir being concentrically spaced from the adjacent inside surface of said tubular member to form a gas discharge passage communicating with said gas reservoir.

5. Apparatus according to claim 4, wherein the groove encircles the cylindrical wall and the passage is of annular shape leading to a single circumferentially-continuous, annular gas-ejection orifice, the passage and orifice being of such configurations that gas is ejected in a direction substantially parallel to the emergent metal stream.

6. Apparatus according to claim 4, wherein the nozzle is fitted to a refractory plate for a sliding gate valve, the plate having a depending nozzle mounting, and the nozzle mounting and tubular member incorporating co-operable releasable fastening means to secure the nozzle detachably to the plate.

7. Apparatus according to claim 4, wherein the nozzle is in two parts, consisting of a main nozzle body and a terminal nozzle tip, and is fitted to a refractory plate for a sliding gate valve, the plate having a depending nozzle mounting, and the nozzle mounting and tubular member incorporating co-operable releasable fastening means to secure the nozzle tip detachably to the main nozzle body.

8. Apparatus according to claim 7, wherein the releasable fastening means is a bayonet coupling.

* * * * *